US005294067A

United States Patent [19]

Tholander et al.

[11] Patent Number: 5,294,067

[45] Date of Patent: Mar. 15, 1994

[54] METHOD OF PREVENTING ROTATIONAL VIBRATIONS IN A THREAD STORAGE AND FEED DEVICE AND A THREAD STORAGE AND FEED DEVICE

[75] Inventors: Lars H. G. Tholander, Ulricehamn; Paer Josefsson, Boras, both of Sweden

[73] Assignee: IRO AB, Ulricehamn, Sweden

[21] Appl. No.: 867,101

[22] PCT Filed: Oct. 30, 1990

[86] PCT No.: PCT/EP90/01937

§ 371 Date: Jun. 22, 1992

§ 102(e) Date: Jun. 22, 1992

[87] PCT Pub. No.: WO91/06500

PCT Pub. Date: May 16, 1991

[30] Foreign Application Priority Data

| | | | |
|---|---|---|---|
| Nov. 3, 1989 | [SE] | Sweden | 8903704 |
| Nov. 6, 1989 | [SE] | Sweden | 8903711 |
| Nov. 10, 1989 | [SE] | Sweden | 8903786 |
| Nov. 13, 1989 | [SE] | Sweden | 8903807 |
| Nov. 21, 1989 | [DE] | Fed. Rep. of Germany | 3938646 |

[51] Int. Cl.[5] ..... B65H 51/20

[52] U.S. Cl. ..... 242/47.01; 242/47.12

[58] Field of Search ..... 242/47.01, 47.12; 139/452; 66/132 R

[56] References Cited

U.S. PATENT DOCUMENTS

| | | | |
|---|---|---|---|
| 4,226,379 | 10/1980 | Brouwer et al. | 242/47.01 |
| 4,280,668 | 7/1981 | Lindstroöm | 242/47.12 |
| 4,397,340 | 8/1983 | Umezawa et al. | 242/47.01 X |
| 4,407,336 | 10/1983 | Steiner | 242/47.01 X |
| 4,418,729 | 12/1983 | Chiba et al. | 242/47.01 X |
| 4,556,088 | 12/1985 | Tanaka et al. | 242/47.01 X |
| 4,848,417 | 7/1989 | Dekker et al. | 139/452 |
| 5,046,537 | 9/1991 | Maina | 242/47.01 X |

FOREIGN PATENT DOCUMENTS

| | | |
|---|---|---|
| 0286584 | 10/1988 | European Pat. Off. . |
| 2843548 | 10/1980 | Fed. Rep. of Germany . |
| 439161 | 12/1967 | Switzerland . |

*Primary Examiner*—Stanley N. Gilreath

*Attorney, Agent, or Firm*—Flynn, Thiel, Boutell & Tanis

[57] ABSTRACT

In the case of a method of holding in position a rotatably supported thread storage surface in a thread storage and feed device, in which a group of components defining the storage surface is rotatably supported on a shaft adapted to be rotated in a housing and in which a winding-on member circulates together with the shaft, whereas magnets prevent the group of components from rotating together with the shaft, a rotational vibration damping connection is temporarily established between the housing and the group of components while the shaft is rotating In a thread storage and feed device (F), which is provided with an advance member (6) adapted to be driven such that it carries out a wobbling movement, there are arranged an externally supported rotational vibration damping member (X) and an abutment (Y) which is provided on the advance member (6). When the device (F) is equipped with a stop device including a movable stop element (23), the stop element (23) constitutes the rotational vibration damping member (X, 50).

10 Claims, 6 Drawing Sheets

METHOD OF PREVENTING ROTATIONAL VIBRATIONS IN A THREAD STORAGE AND FEED DEVICE AND A THREAD STORAGE AND FEED DEVICE

DESCRIPTION

The present invention is directed to a thread storage and feed device.

In the case of a method of the type mentioned at the beginning, which is known from U.S. Pat. No. 4,226,379, the magnets which are fixedly secured to the housing are located radially outside of the group of components, and the magnets arranged in said group of components are located below the storage surface. The magnetic holding forces act at the largest possible distance from the shaft The characteristic curve of the holding force counteracting a rotation of the group of components ascends first flatly and, afterwards, steeply. In the case of modern thread storage and feed devices, high rotational speeds of the shaft occur due to extremely high thread velocities Due to unavoidable unbalanced masses, the thread counterforce which is variable in the direction of rotation, the cantilevered mode of support of the group of components on the shaft, accelerations and decelerations occurring in operation, and other interfering influences, rotary force pulses acting on the group of components may occur, said group of components being then prompted to carry out oscillating movements into both directions of rotation from the holding position defined by the magnets. In view of the holding force characteristic, the group of components will begin building-up rotational vibrations around the desired position, which will reach a resonance state having a large amplitude, e.g. several millimetres. The rotational vibrations cause high strain on the holding means of the magnets, and they make it more difficult to sense the thread supply precisely as well as to maintain a thread take-off tension which is as uniform as possible In cases in which the thread storage and feed device is equipped with an integrated weft thread metering device, the rotational vibrations will interfere with the weft thread metering operation.

It is true that German-pat. 28 43 548 discloses a method of holding in position the group of components in a thread storage and feed device; in the case of said method, the group of components is supported on the housing continuously and in a purely mechanical manner Although this method avoids the disadvantage of a magnetic holding force which is weak around the desired position, it results in a complicated and very special structural design of the device.

The present invention is based on the task of providing a method of the type mentioned at the beginning, which, when the group of components is held in position by means of magnetic holding forces, will avoid interfering rotational vibrations, as well as a thread storage and feed device, which includes a group of components held in position magnetically and which permits, even at high speeds, an operation largely free from rotational vibrations.

The posed task is solved by the features disclosed by the present invention.

The temporarily established rotational vibration damping connection between the housing and the group of components prevents the building up of rotational vibrations of the group of components against the holding force of the magnets which is weak around the desired position. In view of the fact that the rotational vibrations need a certain amount of time for reaching a resonance state and a troublesome amplitude, the build-up tendency is interfered with from the very beginning by the temporary rotational vibration damping connection so that the generation of detrimental rotational vibrations will be prevented completely The forces applied to the group of components during the temporary rotational vibration damping connection can be comparatively small, since the comparatively free oscillation system of the group of components is influenced by said forces in an extremely efficient manner and in such a way that said group of components can actually no longer be prompted to carry out any noticeable oscillations at all.

In view of the fact that, on the one hand, the thread, which moves continuously around the group of components on its way from the winding-on member to the consumer, makes direct access extremely difficult, and in view of the fact that, on the other hand, the building-up of troublesome rotational vibrations needs a specific amount of time, it will suffice to establish the rotational vibration damping connection only over a fraction of one full rotation of the shaft and at least once.

In view of the time required for building up troublesome rotational vibrations, it will suffice to establish the rotational vibration damping connection at intervals which are longer than those determined by the rotational speed of the shaft. These intervals can be regular or irregular.

The rotational vibration damping connection will be time controlled in a reliable manner, when it is established pneumatically, mechanically or magnetically.

When the thread is withdrawn intermittently from a thread supply formed on the storage surface, it will be expedient to establish the rotational vibration damping connection in respective pauses in the thread withdrawal operation. This can then be done on the withdrawal side of the storage surface and precisely at a location at which no thread is present.

In the case of a thread storage and feed device comprising an advance member in the group of components, it will be expedient to provide a rotational vibration damping member, which is supported in a stationary manner relative to the group of components and which is in alignment with an abutment on said advance member, as well as a motion drive means with the aid of which a positive and/or non-positive engagement can be established temporarily so as to already disturb the rotational vibrations when they arise and so as to destroy them to a large extent. The advance member is prevented from rotating together with the shaft anyhow, and it is driven such that it will carry out a wobbling movement and advance the thread on the storage surface. In this connection, it will be expedient to use the wobbling movement for the temporary positive and/or non-positive engagement. The shaft will then so to speak constitute the motion drive means for the temporary cooperation between the rotational vibration damping member and the advance member. If the advance member is of a different nature, e.g. a rod-type cage, which is supported on the shaft eccentrically and at an oblique angle and which is used not only for imparting to the thread the advance movement but also for establishing intervals between the thread windings, the wobbling movement may perhaps not suffice to produce the temporary positive and/or non-positive engagement. If this is the case, it will be expedient to forcibly engage and disengage the rotational vibration damping member. In the first-mentioned case, engagement will be established at least once virtually during each rotation of the shaft. In the last-mentioned case, the intervals between the individual engagements are largely independent of the rotational speed of the shaft. In view of the fact that the interfering rotational vibrations have been eliminated, the strain on the holding means of the magnets will be reduced, perfect sensing of the thread will be possible, and undesirable variations in the tension of the thread withdrawn will be eliminated.

When the rotational vibration damping member enters the wobbling movement area of the advance member from outside, a temporary engagement will be established in the case of each rotation of the shaft, said temporary engagement preventing the generation of rotational vibrations. Notwithstanding this, the storage surface and the other components of the group of components remain easily accessible from outside, in view of the fact that the rotational vibration damping member requires little space and can easily be incorporated into the concept of the device.

Alternatively, it is also possible to arrange the rotational vibration damping member such that it is movable so as to forcibly establish the engagement.

A structurally simple possibility is that in the case of which the rotational vibration damping member is secured in position in a holding means of the housing because the housing is held in a stationary manner and constitutes a comparatively big mass by means of which the forces occurring as a result of the damping of any kind of rotational vibrations can easily be taken up. However, the rotational vibration damping member may just as well be held on a support, which is separated from the housing and which is arranged in a stationary manner just like said housing.

In the case of a particularly simple embodiment, which is space-saving and reliable in function, the rotational vibration damping member is a U-shaped bow, which consists of a resilient material and the crossbow of which cooperates with the abutment The inherent resilience of the bow will avoid any interfereing influence on the operation of the advance member. Notwithstanding this, the engagement between these two parts will suffice to suppress the rotational vibrations.

A continuously uniform damping effect will be achieved by a frictionally active area n the rotational vibration damping member and/or on the abutment. The force transmitted between these two parts in the engaged condition can be small because the frictional engagement will support the damping effect.

The often limited space conditions are taken into account by the solution in the case of which the bow extends approximately radially to the advance member on the axial side of the winding-on member facing the storage surface and is bent towards said advance member. In this area, and in view of the fact that the dimensions of the rotational vibration damping member are limited in the circumferential direction, there will neither be any major impairment of access to the group of components nor will the path of motion of the thread be interfered with.

The engagement force can be very small, when a positive engagement is established between the rotational vibration damping member and the abutment, said positive engagement interrupting abruptly the movement of the group of components away from the desired position.

Alternatively, it will also be expedient to establish the engagement via magnets which contact each other in the condition of engagement.

In order to avoid collisions with the thread or with the winding-on member, it will be important to control the motion drive means of the rotational vibration damping member in a specific manner.

In view of the fact that, for suppressing troublesome rotational vibrations, it will suffice to establish the engagement at larger regular or irregular intervals than the rotational speed of the shaft, the motion drive mans can include a pulse control.

In view of the fact that, for suppressing the troublesome rotational vibrations, it will be important to apply an interference force in addition to the magnetic holding force which is weak around the desired position, the rotational vibration damping member can also be a compressed-air nozzle directing a flow onto the abutment constructed as a guide element.

In a thread storage and feed device, in the case of which the abutment on the group of components does not carry out any movement of its own which would suffice to establish a temporary engagement, the rotational vibration damping member is moved approximately radially to the shaft between an in-operative position and a position of engagement with the aid of a motion drive means connected to a control Measures have been taken to prevent the rotational vibration damping member from colliding with the moving thread or the winding-on member. For the suppression of troublesome rotational vibrations, it is of secondary importance in which area or the group of components the inteference force is applied. It will, however, be expedient to apply said interference force at the largest possible radial distance from the shaft. The period of engagegment can be extremely short In practice, it will suffice to touch the group of components only briefly, e.g. for a few milliseconds.

In this connection, it will be advantageous to use a magnet or a magnetic coil for which the rotational vibration damping member defines a pushrod-shaped armature. It is thus posible to achieve short and precisely controlled periods of engagement The control can be effected by means of the signals which are used in the device for the operational control thereof anyhow.

In order to reliably apply the interference force in the case of short periods of engagement, it will be expedient to establish between the head of the rotational vibration damping member and a recess in the storage surface a positive and/or non-positive engagement. The group of components will thus immediately be centered in the desired position.

This effect will be produced in a particularly precise manner, when the recess is adapted to the shape of the head.

Alternatively, it is also imaginable to provide an elastic, frictionally active pad in the recess or on the head. This will protect the rotational vibration damping member and the group of components. The interfernce force pulse is particularly suitable for suppressing the generation of the troublesome rotational vibrations. Moreover, undesirable noise and wear is avoided.

In a thread storage and feed device in the case of which the storage surface has associated therewith a thread stopping device including a stop element, it will be expedient to displace the rotational vibration damping member axially or/and in the circumferential direction relative to the stop element so as to avoid mutual interference. It will be advantageous to establish engagement of the rotational vibration damping member at a moment at which the thread is secured in position by the stop element. The period of engagement used may be the same period which is predetermined for holding the thread in position. The engagement need not necessarily be established in the case of each actuation of the stop device. Also longer intervals between the individual engagements will suppress the generation of interfering rotational vibrations.

The rotational vibration damping member plus its motion drive means can also be integrated in the stop device; this will save space and permit free access to the group of components.

Finally, according to a double function of the stop element, the rotational vibration damping member can be defined by the stop element of the stop device itself. For holding the thread in position, the stop element is required in the circumferential direction of the storage surface as an obstacle. For suppressing interfering rotational vibrations, the engagement between the stop element and the storage surface is used at a point locally separated therefrom.

BRIEF DESCRIPTION OF THE DRAWINGS

Embodiments of the subject matter of the invention explained on the basis of the drawing, in which.

DETAILED DESCRIPTION

Figure 1:
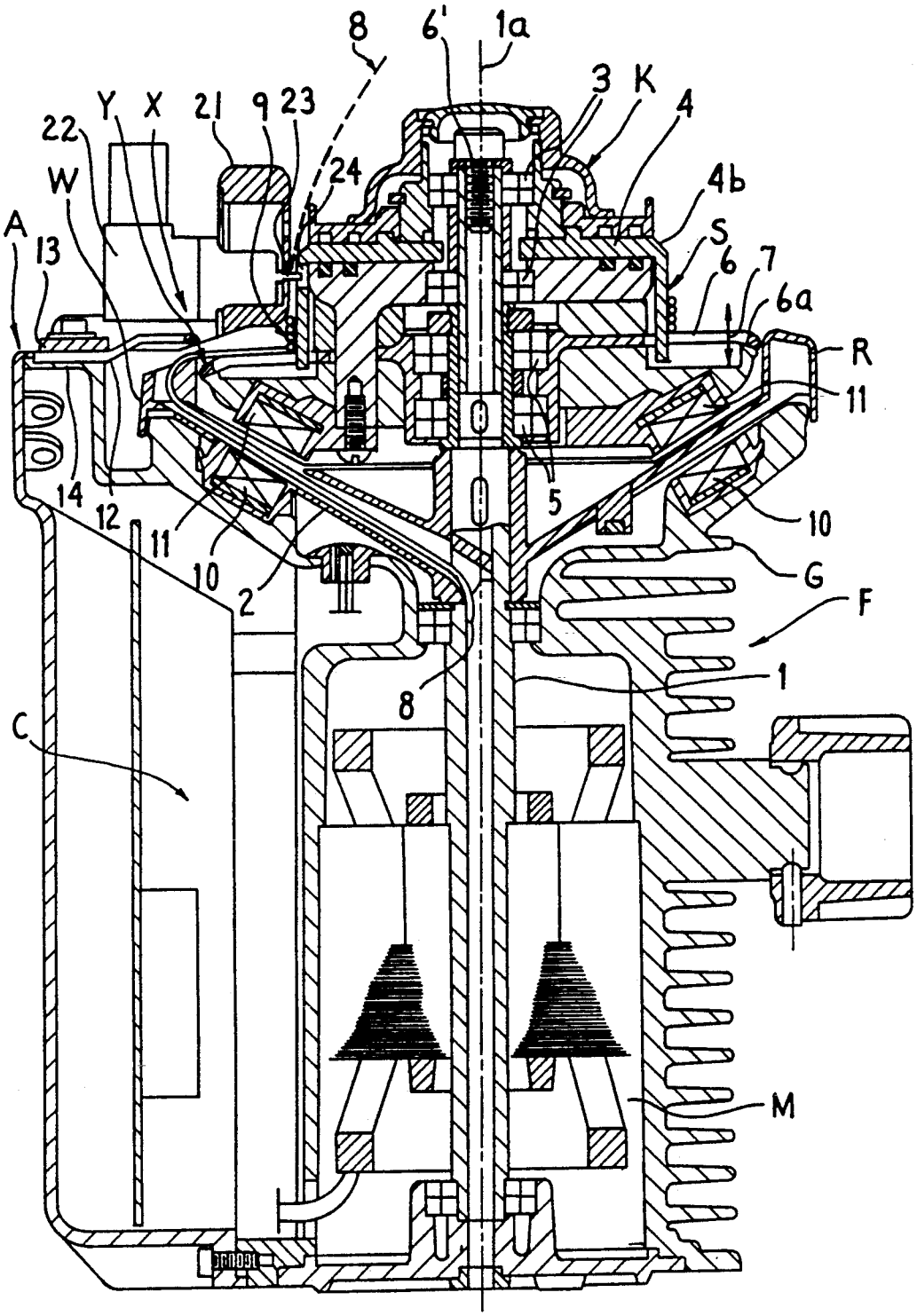
FIG. 1 shows a longitudinal section through a thread storage and feed device.
Figure 2:
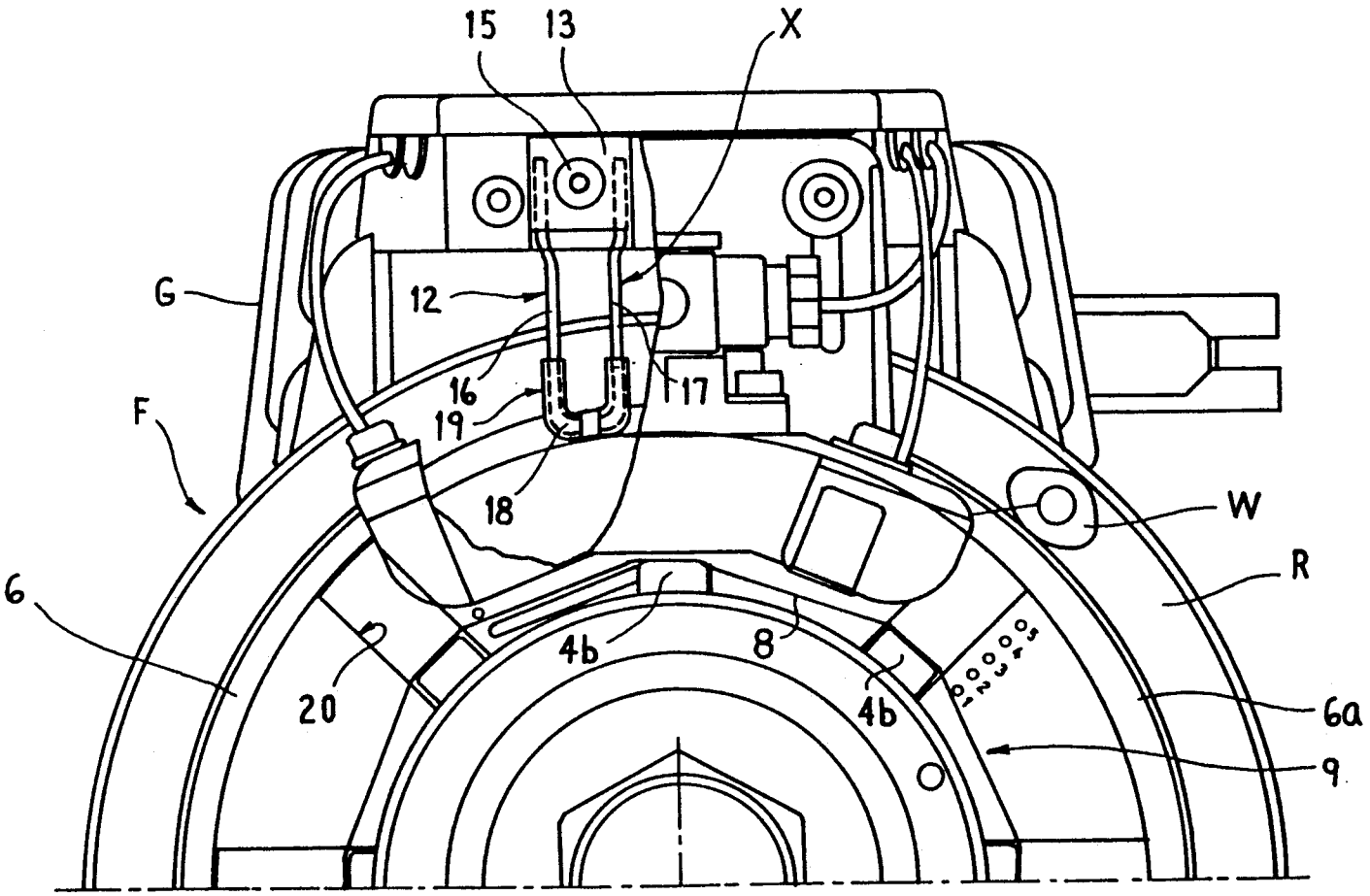
FIG. 2 shows one half of a front view of FIG. 1.
Figure 3:
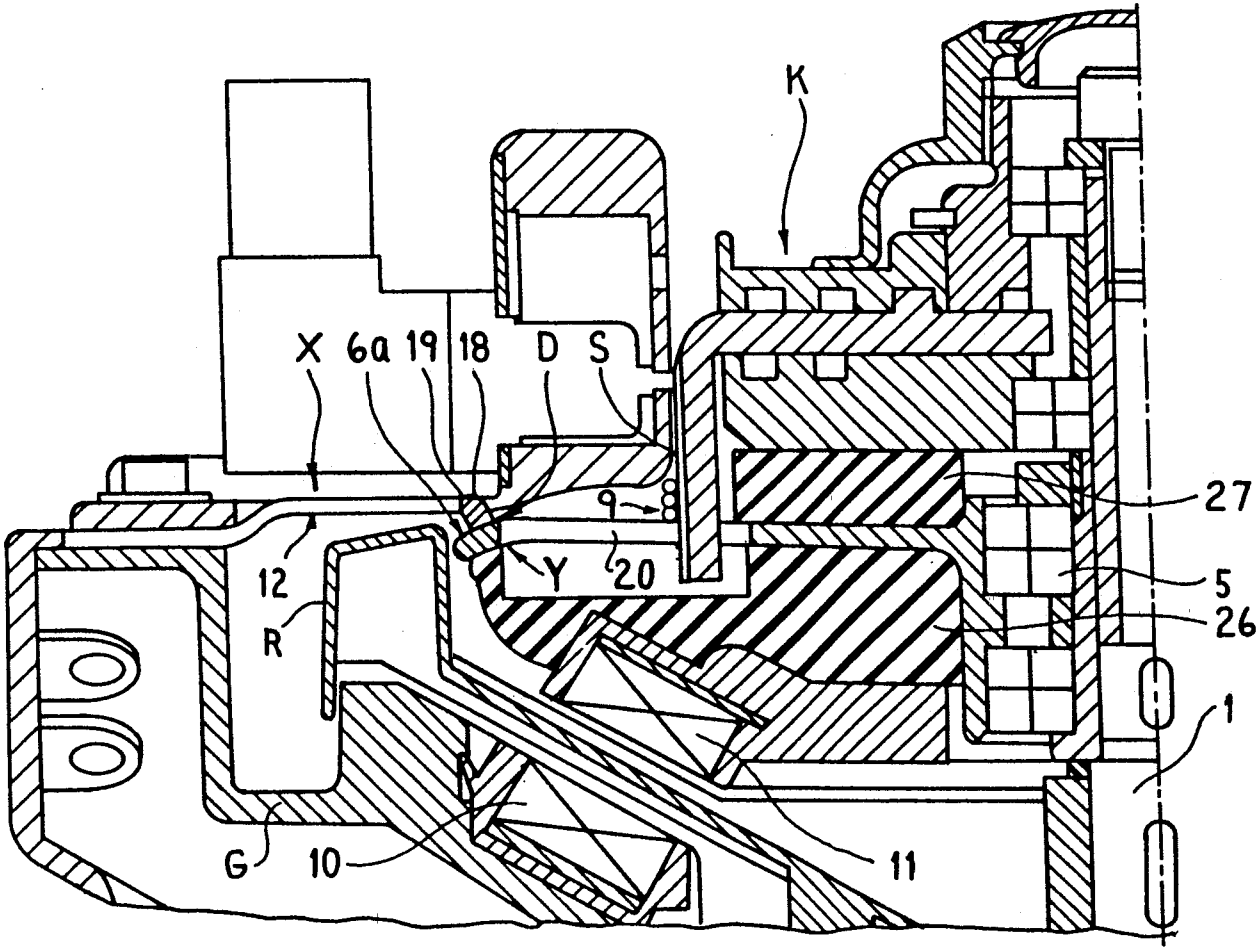
FIG. 3 shows an enlarged fragmentary longitudinal section taken from FIG. 1 and 2 in a different operating position.

A thread storage and feed device F according to FIG. 1 to 3 contains in a housing G, which is supported in a stationary manner, a drive motor M for a shaft 1 carrying an obliquely projecting winding tube 2. The housing has arranged therein a control means C for the drive motor M, said control means C being in signal-receiving connection with sensor means, which are not shown in detail. The winding tube 2 is integrated in an annular body R containing a winding-on member W. The housing has provided thereon a support A for a rotational vibration damping member X, which is adapted to be temporarily brought into engagement with an abutment Y so as to establish a rotational vibration damping connection D (FIG. 3).

A group of components K is supported, in bearings 3, on the free end of the shaft 1 projecting beyond the annular body R, said group of components K comprising, in addition to constituent parts which are not specified in detail, a storage member 4, which consists of individual segments and which is provided with axially extending arms 4*b*. Said arms 4*b* define a polygonal storage surface S. Furthermore, an advance member 6 is rotatably supported, in bearings 5, on the free end of the shaft 1, said advance member 6 projecting outwards beyond the storage surface S up to a point in the vicinity of the annular body R. The axis of rotation 6*a* of the advance member 6 extends at an oblique angle relative to the axis of rotation Ia of the shaft I in such a way that the advance member 6 is tilted towards the winding-on member W. The housing G has magnets 10 arranged therein, said magnets 10 being in alignment with magnets 11 in the group of components K. Between the magnets 10, 11, a gap is provided, which permits the winding tube 2 to be passed through and across which magnetic holding forces are effective, which prevent the group of components K and the advance member 6 from rotating together with the shaft 1. When the shaft 1 rotates, the advance member 6, which is prevented from rotating together with the shaft, is prompted to carry out a wobbling movement (wobbling area 7).

A thread 8 supplied through the hollow shaft 1 extends through the winding tube 2 and the winding-on member W by means of which said thread is placed onto the storage surface S in the form of a thread supply 9 consisting of individual windings. A dot-and-dash line indicates how the thread is withdrawn overhead from the storage surface S. When carrying out its wobbling movement, the advance member 6 continuously advances the thread supply 9 from the winding-on member W in the axial direction.

The rotational vibration damping member is a U-shaped bow 12 (FIG. 2), which is formed of spring-steel wire and which is clamped in position in a reception means 14 of the housing by means of a locking or holding element 31 and a locking screw 15. The U legs of the bow 12, which are provided with reference numerals 16 and 17, are bent and extend across the circulatory path of the winding-on member W to the advance member 6. A crossbow 18, which interconnects the legs 16, 17, extends approximately tangentially to the shaft 1 Said crossbow 18 is provided with a frictionally active area, e g. coating 19 having high frictional properties. The bow 12 is bent towards the advance member 6 in the area of the crossbow 18.

The device F according to FIG. 1 is constructed as a weft thread metering device releasing from the thread supply 9 individual sections of precisely dimensioned length for withdrawal. For this purpose, the housing has provided thereon a stop device 21, which has attached thereto a magnetic coil or a magnet as a motion drive means 22 for a pushrod-shaped stop element 23. The stop element 23 is adapted to be moved into a recess 24, which is provided in said storage surface S, so as to stop the thread 8 which circulates while being withdrawn. When the stop element 23 is drawn back, the thread will pass unhindered.

Figure 4:
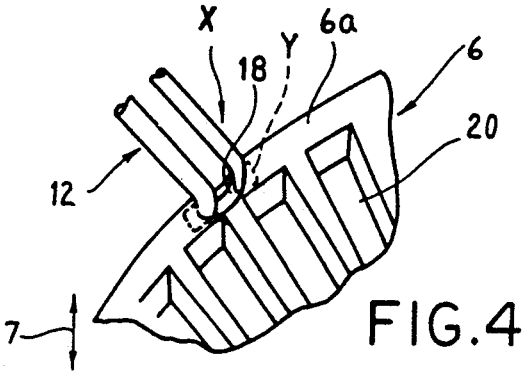
FIG. 4 shows a perspective view of a detail taken from FIG. 3, FIGS. 5*a*–5*i* show sectional views of various embodiments of the rotational damping member and the abutment associate therewith.

In FIG. 2, it can be seen that the longitudinal rods 4*b* of the storage member 4 engage radial slots 20 of the advance member 6. The annular rim of the advance member 6, which is provided with reference numeral 6*a*, (FIG. 4) serves at one point of the circumference as the abutment Y for the rotational vibration damping member X. If desired, a frictionally-active coating is provided at this location, or a recess, which is adapted to be brought into positive engagement with the bow 12, when the rim 6*a* comes into contact with said bow 12 in the wobbling area 7 of the advance member 6 so as to establish a temporary rotational vibration damping connection.

The diameter of the storage surface S is variable. For this purpose, the segments of the storage member 4 are adapted to be radially adjusted In FIG. 3, the winding-on member W has been rotated by approx. 180° relative to its position in FIG. 1. The advance member 6 has moved axially relative to the bow 12 until the rotational vibration damping connection D has been established by engagement between the crossbow 18 and the surface 6a. The crossbow 18 has a length which is limited in the circumferential direction of the advance member 6 to a small number of angular degrees in such a way that the engagement will be maintained throughout approx. ¼ of one full rotation of the shaft 1 before the advance member 6 separates from said crossbow 18 and opens a gap (FIG. 1) in which the thread 8 will pass the bow 12 without being caught. In the condition of engagement, rotational vibrations of the group of components K which normally would be in the process of developing are suppressed so that the group of components will hold still in the desired position determined by the magnets 10, 11.

According to FIG. 3, elastic filling members 26, 27 are arranged in the interior of the group of components. Thanks to the elasticity of said filling members 26, 27, the wobbling movement of the advance member 6 is not impaired.

FIG. 5a to 5i show various embodiments of the rotational vibration damping member X and of the abutment Y associated therewith.

Figure 5A:
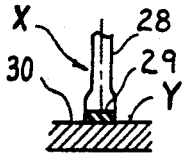

In FIG. 5a, the rotational vibration damping member X is a pin 28, the head of said pin 28 having attached thereto a friction coating 29, which is pressed onto a flat surface 30 of the abutment Y.

Figure 5B:
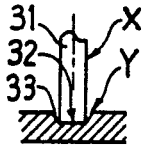

In FIG. 5b, the rotational vibration damping member X is a pushrod 31 whose head 32 enters a preferably conically enlarged recess 33 of the abutment Y.

Figure 5C:
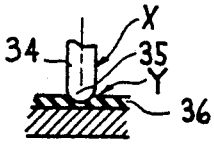

In FIG. 5c, the rotational vibration damping member X is a pushrod 34 having a rounded head 35, which is pressed into an elastic coating 36 of the abutment Y.

Figure 5D:
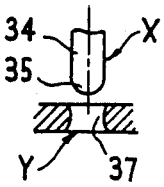

In FIG. 5d, the rounded head 35 of the rotational vibration damping member X is inserted into a recess or in a hole 37 of the abutment Y. The walls of the hole can be rounded or conically enlarged.

Figure 5E:
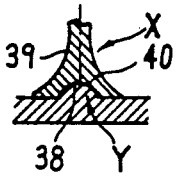

In FIG. 5e, the rotational vibration damping member X has the shape of a mushroom 39 with a recess 40, which is formed at the bottom thereof and which is placed onto a projection 38 of the abutment Y.

Figure 5F:
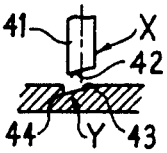

In FIG. 5f, the rotational vibration damping member X is a pin 41 having an oblique head 42. The abutment Y has the form of a saw-tooth recess 43 with a stop means 44 provided at one side thereof For suppressing the rotational vibrations, it will suffice to guarantee a reliable positive engagement in only one direction of rotation.

Figure 5G:
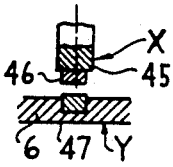

In FIG. 5g, the rotational vibration damping member X is a pushrod 45 carrying a magnet 46 at the head thereof. The abutment Y is either made of magnetic material or equipped with a magnet 47 by means of which a non-positive engagement is established when the magnet 46 is in contact therewith. The abutment Y can be contained in the advance member 6.

Figure 5H:
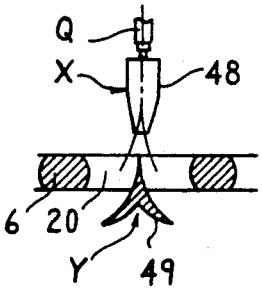

According to FIG. 5h, the rotational vibration damping member X is a compressed-air nozzle 48, which is connected to a pressure source Q and which is in alignment with the abutment Y having the form of a guide element 49. The jet discharged from said nozzle 48 produces on the guide surface 49 an interference force which will prevent the development of rotational vibrations. The slots 20 in the advance member 6 serve as flow passages at both sides of the guide element 49.

Figure 5I:
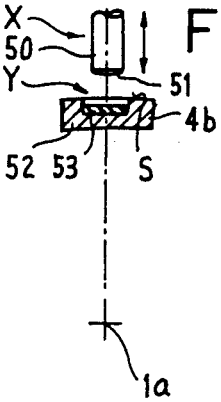

According to FIG. 5i, the rotational vibration damping member X is a pushrod 50 whose head 51 is adapted to be inserted into a recess 52 of the abutment Y. An elastic friction coating 53 is provided at the bottom of the recess 52. The abutment Y can be arranged either in the advance member 6 or—as indicated in this FIG. 5i—in one of the longitudinal rods 4b of the storage member 4. The rotational vibration damping member X requires a motion drive means imparting thereto the movements indicated in the direction of the double arrow.

Figure 6:
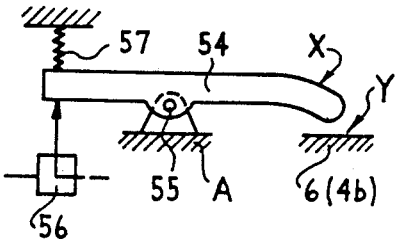
FIG. 6 shows a schematic representation of an additional detail variation.

In FIG. 6, a motion drive means for a rotational vibration damping member X, which is constructed as a double lever 54, is schematically outlined. The double lever 54 is adapted to be pivoted in the support A about an axis 55 and one end thereof is acted upon by a motion drive means 56 including a pulse control. A readjusting spring 57 counteracts the motion drive means 56. The abutment Y can be arranged either on the advance member 6 or on a longitudinal rod 4b of the storage member 4.

Figure 7:
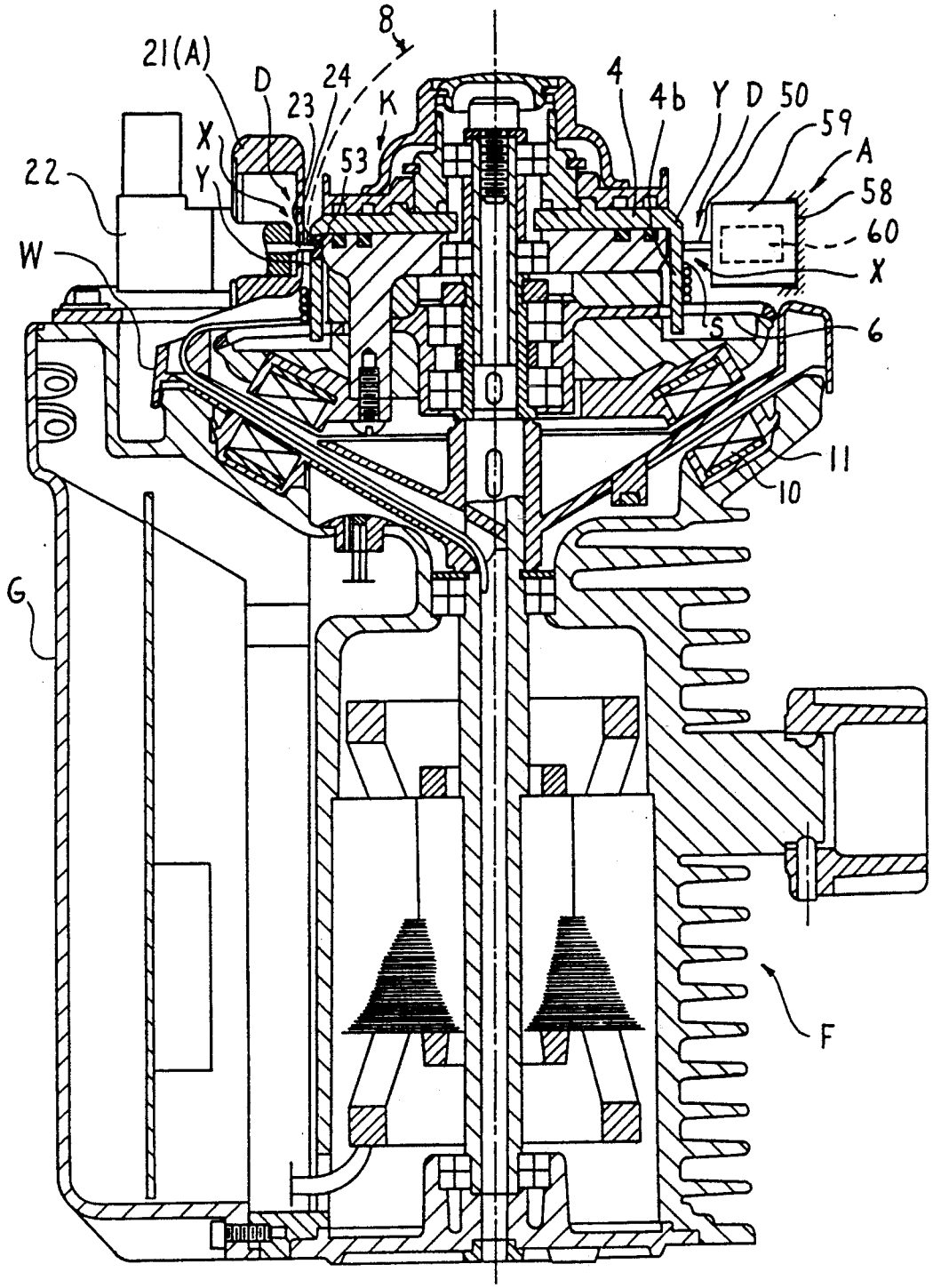
FIG. 7 shows a longitudinal sectional view of an additional embodiment of a thread storage and feed device.
Figure 8:
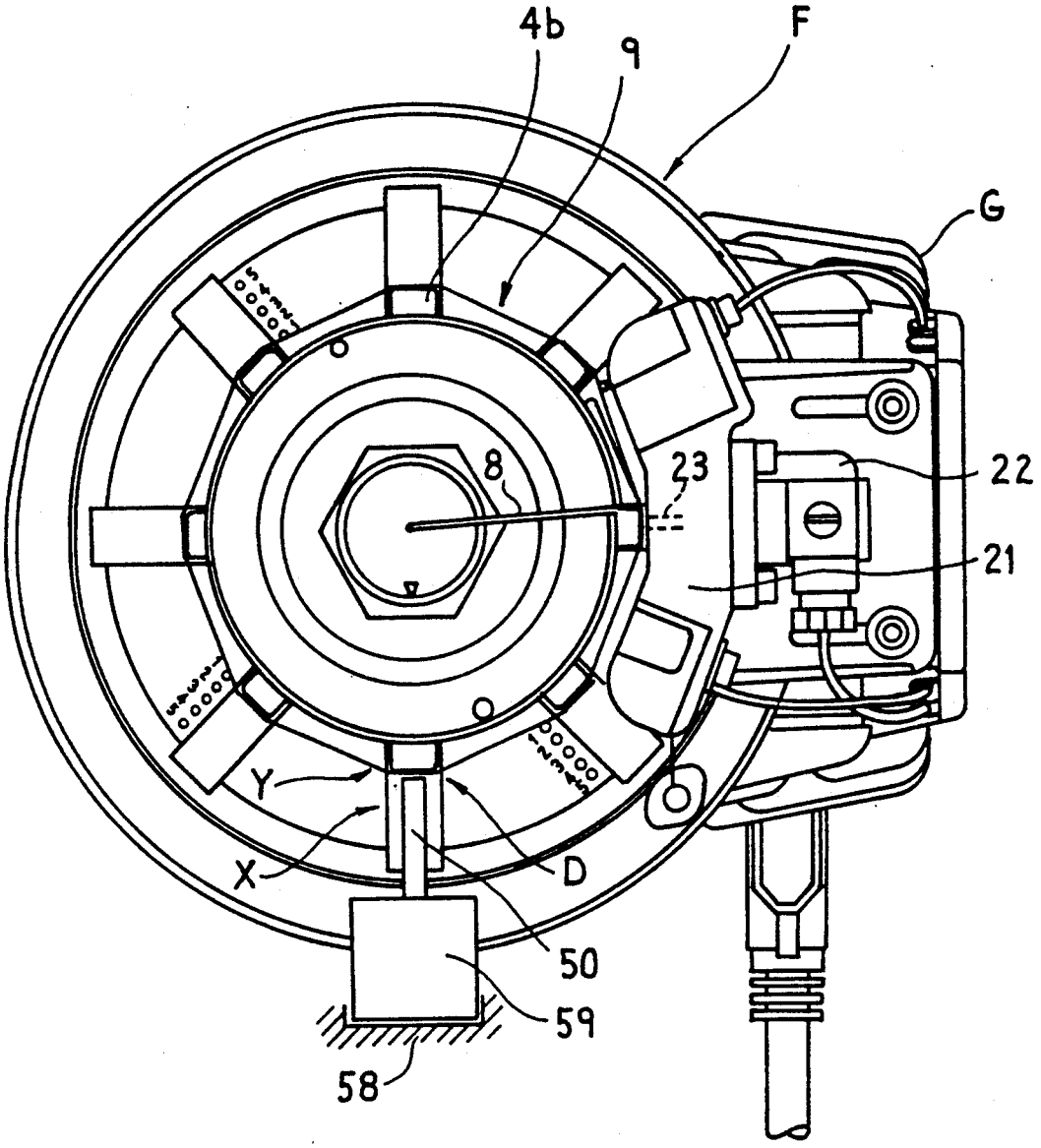
FIG. 8 shows a front view of FIG. 7, FIG. 7 and 8 showing two structural variations side by side.

In the case of an additional embodiment of a thread storage and feed device F according to FIG. 7 and 8 wherein said stop element 23 is not permitted to contact the storage surface S, the rotational vibration damping connection D is established between a support A, 58, which is stationary relative to the group of components K, and the storage surface S. The rotational vibration damping member X has the structural design shown in FIG. 5i, i.e. the head of the pushrod 50 is radially brought into contact with the storage surface S so as to establish the engagement. In the support 58, which may be, but need not be part of the housing G, a holding means 59 for a motion drive means 60 is held. It will be expedient to connect the motion drive means 60 to a control, which will actuate the rotational vibration damping member X only if the thread 8 is just standing still in a pause in the withdrawal. The rest of the structural design of the device F according to FIG. 7 corresponds to the structural design of FIG. 1 to 3. When the device F is equipped with a stop device 21, the rotational vibration damping member X will be brought into engagement whenever the stop element 23 stops the thread delivered. According to FIG. 7 and 8, the rotational vibration damping member X is displaced relative to the stop device 21 in the circumferential direction It is also imaginable to displace the rotational vibration damping member relative to the stop device 21 in the axial direction. In FIG. 7 the displacement amounts to 180° in the circumferential direction, in FIG. 8 it amounts only to 90°.

In the case of this embodiment, the rotational vibration damping member X, is arranged separately from the stop device 21 in a support A, 58 of its own. This principle may also be used for a thread storage and feed device which does not include any stop device, provided that the motion drive means 60 is controlled in response to the thread withdrawal motion.

However, it is possible to structurally integrate the rotational vibration damping member X plus its motion drive means 60 into the stop device 21 by permitting the stop element 23 to contact the storage surface thus carrying out the dual functions of stopping the thread 8, and suppressing rotational vibrations. It will be particularly expedient, when the stop element 23 simultaneously defines the rotational vibration damping member X by positively cooperating with the recess 24 or by being pressed onto an elastic coating 53 within said recess 24 as shown in FIG. 5*i*, so that the temporary rotational vibration damping connection D will be established whenever the thread has to be stopped In this case, no additional rotational vibration damping member X will be required.

We claim:

1. In a thread storage and feed device including a housing rotatably supporting a driven shaft having a thread winding-on member coupled thereto, a component group rotatably supported on said shaft and including at least one thread storage member defining a thread storage surface, a thread advance member extending obliquely relative to said shaft and driven such that it carries out a wobbling movement relative to the thread storage surface, said thread advance member projecting radially beyond said thread storage surface, and at least one magnet arranged within said component group and cooperating with at least one magnet fixedly secured to said housing to prevent said component group from rotating with said shaft, the improvement comprising: a support which is stationary relative to said component group; at least one rotational vibrational damping member coupled to said support, said damping member being of limited extent in a circumferential direction of said storage surface; an abutment disposed on said thread advance member which is in alignment with said damping member; and a motion drive means for temporarily bringing said abutment into vibration-damping engagement with said first damping member during only a portion of one complete rotation of said shaft.

2. The device as claimed in claim 1, further including a holding means for releasably and adjustably coupling said damping member to said support.

3. The device as claimed in claim 2, wherein said damping member is a U-shaped bow having first and second spaced-apart legs each being fixedly secured to said support by said holding means, and a crossbow traversely coupled to said legs at free ends thereof, said crossbow positioned approximately tangentially with respect to an axis of rotation of said shaft and which is in alignment with said abutment, said abutment contacting said crossbow during said portion of one complete rotation of said shaft.

4. The device as claimed in claim 3, wherein said U-shaped bow is made of a resilient material such as spring-steel wire, said resilient material permitting said damping member to be temporarily displaced when said abutment contacts said crossbow.

5. The device as claimed in claim 3, wherein at least one of said crossbow and said abutment include a coating having high frictional properties.

6. The device as claimed in claim 3, wherein said U-shaped bow radially extends from said support to said advance member along a side of said winding-on member facing said storage surface, said crossbow being angled toward said advance member.

7. The device as claimed in claim 1, wherein said damping member and said abutment include opposing surfaces for causing positive engagement therebetween in the direction of rotation of said shaft.

8. The device as claimed in claim 7, wherein at least one of said opposing surfaces includes a magnet.

9. The thread storage and feed device as claimed in claim 1, wherein said damping member is a compressed-air nozzle, and said abutment is a guide element for an air flow discharged from said nozzle.

10. A method of temporarily disturbing the generation, development or continuation of rotational vibrations that develop within a thread storage and feed device, said thread storage and feed device including a housing rotatably supporting a driven shaft having a thread winding-on member coupled thereto, a component group rotatably supported on said shaft and including at least one thread storage member defining a thread storage surface, a thread advance member extending obliquely relative to said shaft and driven such that it carries out a wobbling movement relative to the thread storage surface, said thread advance member projecting radially beyond said thread storage surface, and at least one magnet arranged within said component group, and cooperating with at least one magnet fixedly secured to said housing to prevent said component group from rotating with said shaft, said method comprising the steps of:

rotating said shaft;

causing said thread advance member to carry out said wobbling movement in response to said shaft rotation; and causing an abutment disposed on a circumference of said thread advance member to temporarily engage a rotational vibrational damping member mounted on said frame during only a portion of one complete rotation of said shaft.

* * * * *